US008145080B2

(12) United States Patent
Murata et al.

(10) Patent No.: US 8,145,080 B2
(45) Date of Patent: Mar. 27, 2012

(54) IMAGE FORMING APPARATUS

(75) Inventors: Shigemi Murata, Kanagawa (JP); Makoto Kanno, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 309 days.

(21) Appl. No.: 12/630,335

(22) Filed: Dec. 3, 2009

(65) Prior Publication Data

US 2010/0247120 A1 Sep. 30, 2010

(30) Foreign Application Priority Data

Mar. 25, 2009 (JP) ..... P2009-073287
Jun. 25, 2009 (JP) ..... P2009-150570

(51) Int. Cl.
*G03G 15/00* (2006.01)
*G03G 15/08* (2006.01)

(52) U.S. Cl. ..... 399/43; 399/44; 399/253

(58) Field of Classification Search ..... 399/43, 399/44, 53, 97, 253
See application file for complete search history.

(56) References Cited

U.S. PATENT DOCUMENTS

| | | | | |
|---|---|---|---|---|
| 2004/0101322 | A1 | 5/2004 | Tsukida et al. | |
| 2005/0190386 | A1 | 9/2005 | Zaima | |
| 2005/0201766 | A1 * | 9/2005 | Tsukida et al. | 399/27 |

FOREIGN PATENT DOCUMENTS

| | | | |
|---|---|---|---|
| JP | 55-101959 | | 8/1980 |
| JP | 57-019769 | | 2/1982 |
| JP | 59-116768 | | 7/1984 |
| JP | 01-269953 | | 10/1989 |
| JP | 02-097971 | | 4/1990 |
| JP | 6-35312 | A | 2/1994 |
| JP | 2000-66460 | A | 3/2000 |
| JP | 2000-98734 | | 4/2000 |
| JP | 2004-110011 | | 4/2004 |
| JP | A-2007-65581 | | 2/2005 |
| JP | 2005-140917 | | 6/2005 |
| JP | 2005-189356 | | 7/2005 |
| JP | 2007-003952 | | 1/2007 |
| JP | 2007-73287 | A | 3/2007 |
| JP | 2007065581 | A * | 3/2007 |

OTHER PUBLICATIONS

"Notification of Reason for Refusal" Patent Application No. 2009-073287; Drafting date: Feb. 24, 2011.

* cited by examiner

*Primary Examiner* — David Gray
*Assistant Examiner* — Frederick Wenderoth
(74) *Attorney, Agent, or Firm* — Morgan, Lewis & Bockius LLP

(57) ABSTRACT

An image forming apparatus includes an image forming device, a time detection unit, a humidity measurement unit and a controller. The image forming device includes a photoconductive body, a developing device and a transfer device. The time detection unit detects information concerning a stop time period of the developing device. The humidity measurement unit is provided in a casing in which the image forming device is provided and measures a humidity. The controller controls a developer supply member in the developing device based on the information concerning the stop time period detected by the time detection unit and information concerning the humidity measured by the humidity measurement unit, so as to rotate at a lower speed than a rotation speed at a normal time before the developing device starts a first developing operation after the developing device stopped.

10 Claims, 13 Drawing Sheets

[NORMAL CONTROL]
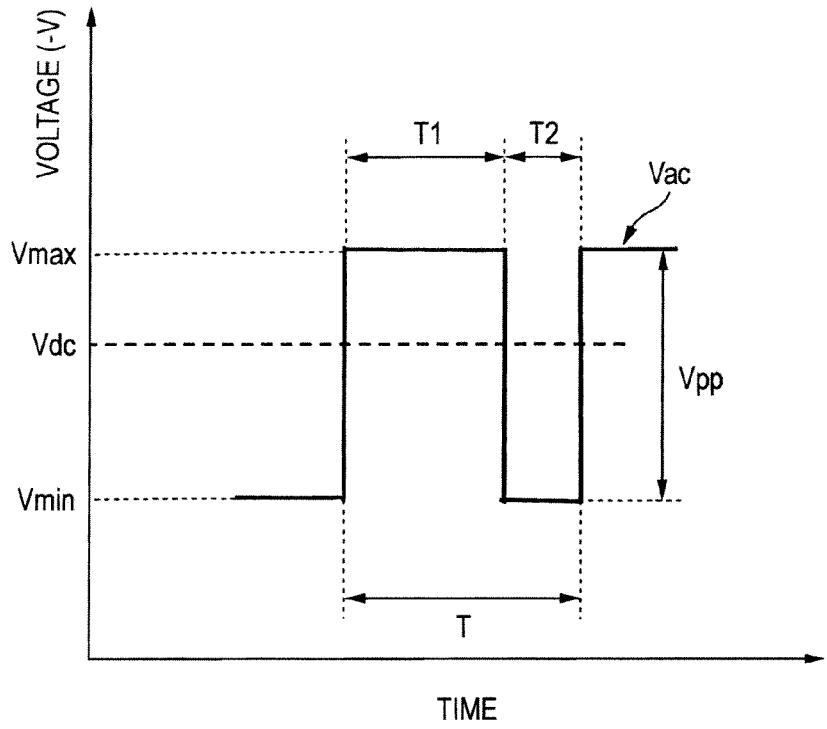
FIG. 8
[SPECIAL CONTROL]
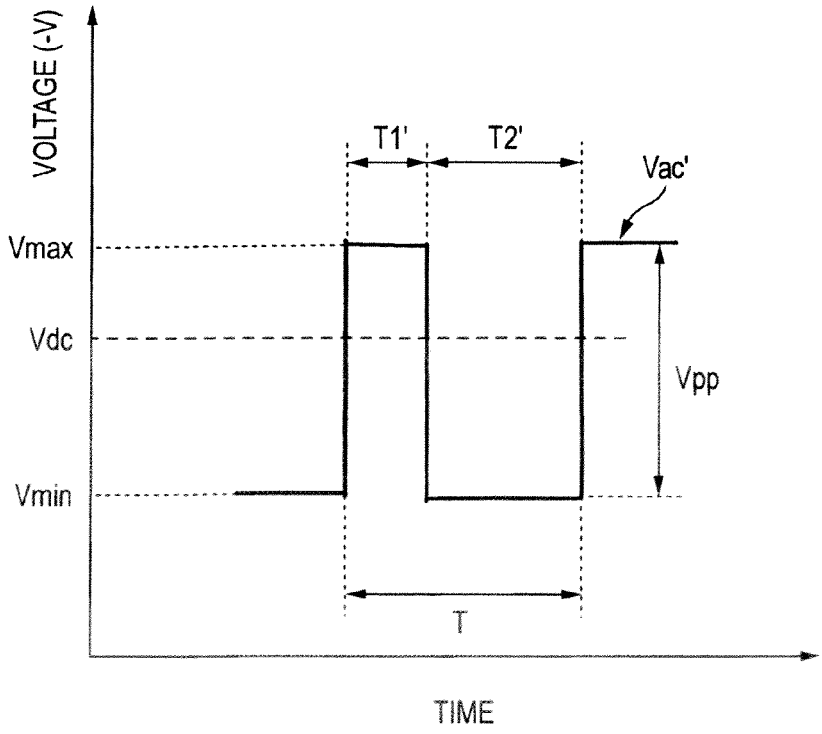

IMAGE FORMING APPARATUS

CROSS-REFERENCE TO RELATED APPLICATIONS

This application is based on and claims priority under 35 USC 119 from Japanese Patent Application No. 2009-73287 filed Mar. 25, 2009 and Japanese Patent Application No. 2009-150570 filed Jun. 25, 2009.

BACKGROUND

1. Technical Field

This invention relates to an image forming apparatus.

2. Related Art

In an image forming apparatus, such as a printer, a copier and a facsimile, for forming a developer image which is developed on a photoconductive body with a dry developer and finally transferring the developer image to a recording medium to form an image, as the quiescent period from completion of one image forming operation to the start of another image forming operation becomes longer, fogging such that a developer is deposited on a white background portion may occur or a defect such that the image density gets higher than an intended density may occur in the image forming operation started after the quiescent period. Such a defect tends to occur remarkably in an environment in which the humidity during the quiescent period is comparatively high.

SUMMARY

According to an aspect of the invention, an image forming apparatus includes an image forming device, a time detection unit, a humidity measurement unit and a controller. The image forming device includes a photoconductive body, a developing device and a transfer device. The photoconductive body rotates. An electrostatic latent image is formed on the photoconductive body. The developing device develops the electrostatic latent image on the photoconductive body with a developer to form a developer image. The developer is supplied by a developer supply member which rotates and to which a developing voltage is applied. The transfer device transfers the developer image onto a recording medium. The time detection unit detects information concerning a stop time period of the developing device. The humidity measurement unit is provided in a casing in which the image forming device is provided and measures a humidity. The controller controls the developer supply member in the developing device based on the information concerning the stop time period detected by the time detection unit and information concerning the humidity measured by the humidity measurement unit, so as to rotate at a lower speed than a rotation speed at a normal time before the developing device starts a first developing operation after the developing device stopped.

BRIEF DESCRIPTION OF THE DRAWINGS

Exemplary embodiments of the invention will be described in detail below with reference to the accompanying drawings, wherein

FIG. 8 is a schematic representation to show the configuration of normal control and special control concerning the developing bias as voltage waveforms, etc., in the exemplary embodiment 3;

DETAILED DESCRIPTION

Exemplary embodiments of the invention will be described below with reference to the accompanying drawings.

[Exemplary Embodiment 1]

Figure 1:
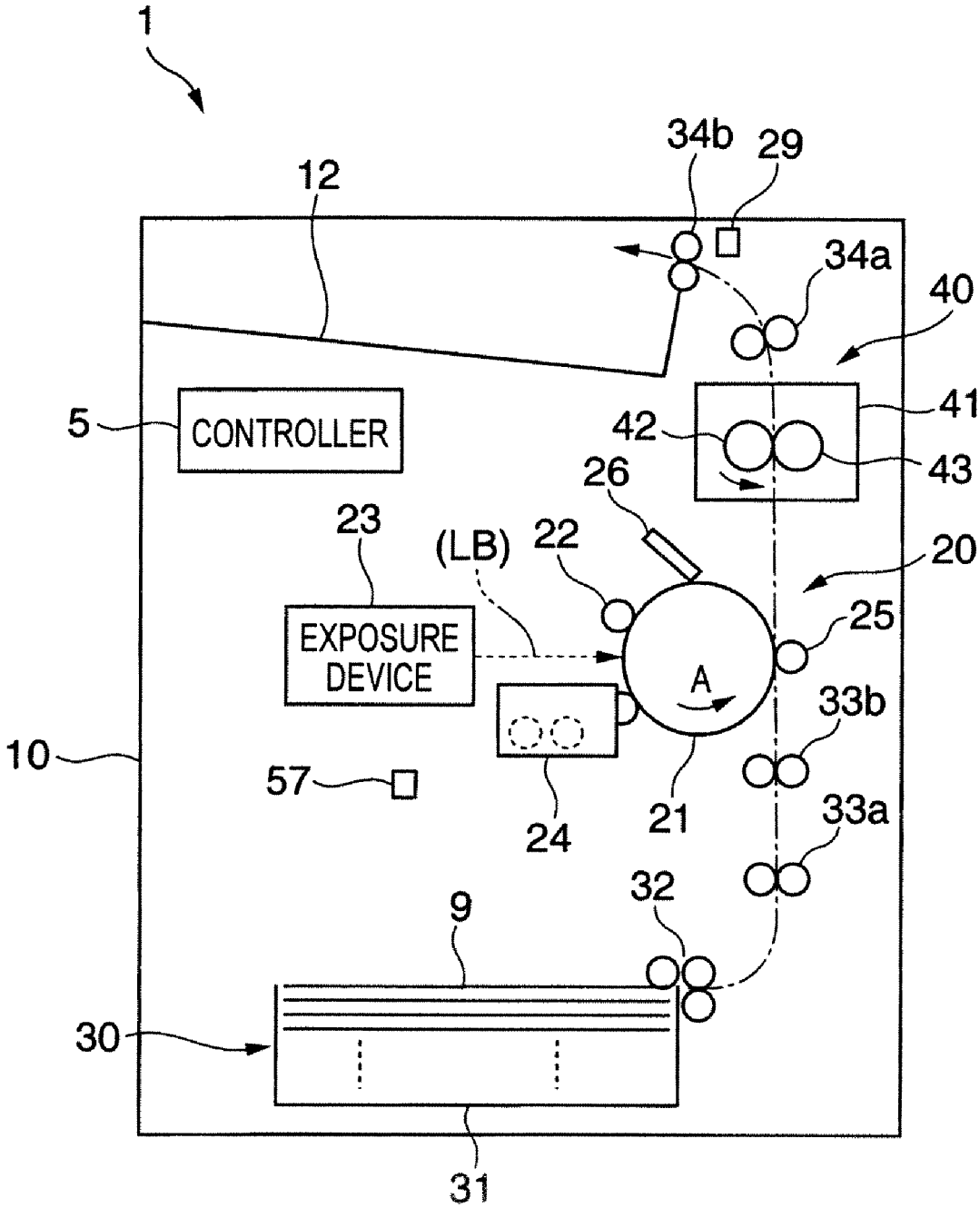
FIG. 1 is a schematic representation to show the outline of an image forming apparatus according to an exemplary embodiment 1 (2-4) of the invention.
Figure 2:
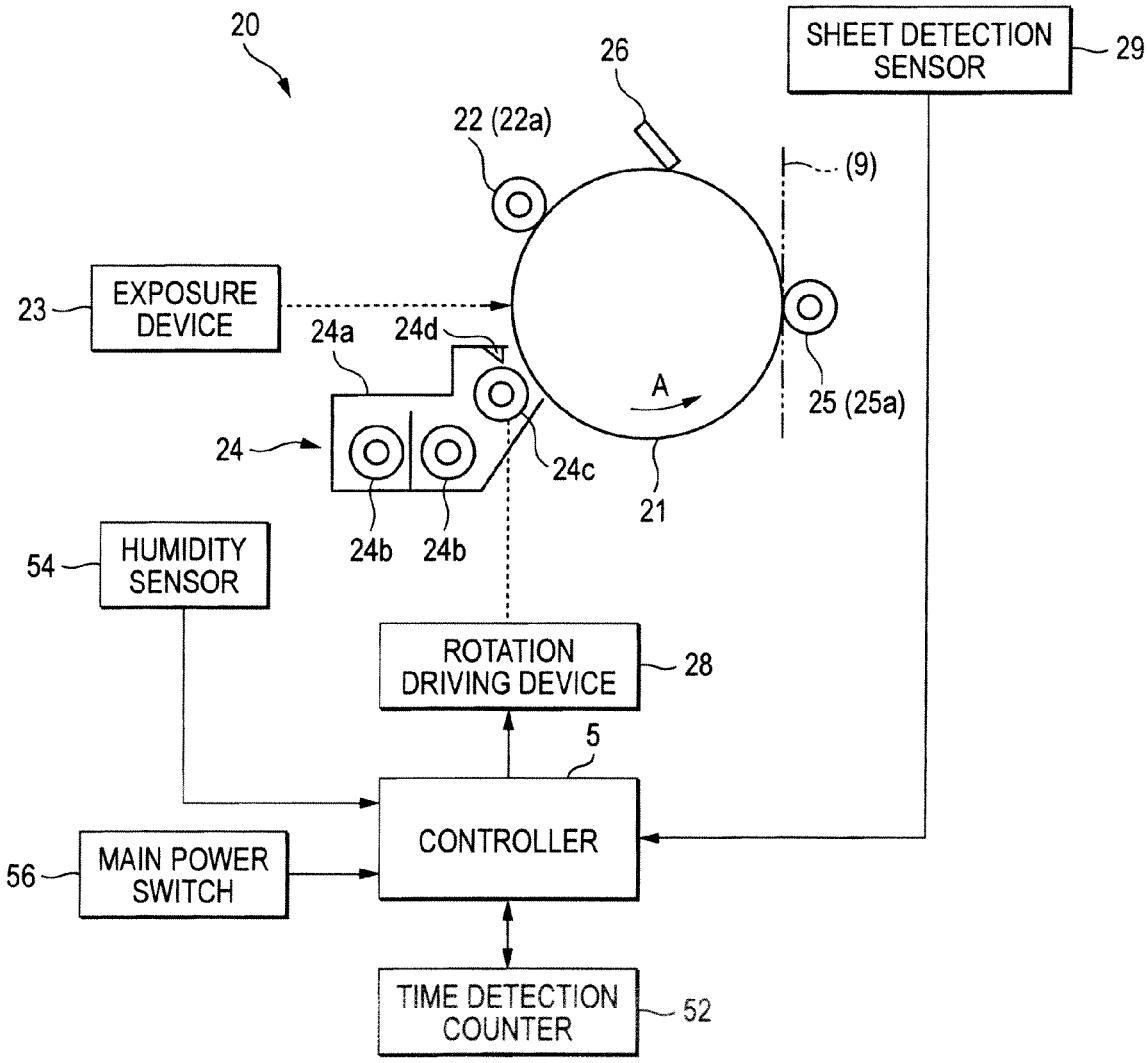
FIG. 2 is a schematic representation to show the configuration of a main control system of the image forming apparatus.

FIG. 1 shows the outline of an image forming apparatus 1 according to an exemplary embodiment 1 of the invention. FIG. 2 shows a main part of the image forming apparatus 1.

The image forming apparatus 1 according to this exemplary embodiment has an image forming device 20, a sheet feeder 30, a fixing device 40 and a controller 5 which are installed in the internal space of a casing 10 made up of a support member, an external cover, etc. The image forming device 20 forms a toner image with a toner which is a developer on a photoconductive body 21 and transfers the toner image onto a recording sheet 9. The sheet feeder 30 stores and conveys required recording sheets 9 to be supplied to the image forming device 20. The fixing device 40 fixes the toner image transferred to the recording sheet 9. The controller 5 overall controls operations of respective components which constitute the image forming apparatus.

The image forming device 20 uses known electrophotography and includes the photoconductive body 21 of a drum form which is rotatably arranged, a charging device 22 which is arranged to surround the photoconductive body 21, an exposure device 23, a developing device 24, a transfer device 25, a cleaner 26, etc.

The photoconductive body 21 is obtained by forming a photoconductive layer, etc., on a cylindrical peripheral surface of a conductive cylindrical base material which is rotatably supported and grounded. The photoconductive body 21 rotates at a required speed in a required direction (a direction indicated by an arrow A) by power of a rotation drive (not shown). The cleaner 26 includes a cleaning member, such as an elastic plate, that comes into contact with the peripheral surface of the photoconductive body 21 after transfer, and a collection vessel that collects deposits, such as toner, removed by the cleaning member.

The charging device 22 charges an image formation effective area, in a rotation axis direction, of the peripheral surface of the photoconductive body 21 to a required voltage. An example of the charging device 22 applies a charging voltage from a power source (not shown) to a charging roll 22*a* which is disposed so as to come in contact with at least the image formation effective area of the photoconductive body 21 and to rotate. As the charging roll 22*a*, a roll obtained by forming on a conductive core material an elastic layer made of a material such as rubber which is mixed with a conductive agent, for example, is used. Examples of the charging voltage include a DC voltage or a voltage obtained by superposing an AC voltage on a DC voltage.

The exposure device 23 applies light to the photoconductive body 21 in accordance with image information which is input to the image forming apparatus 1, so as to form an electrostatic latent image. Examples of the exposure device 23 include a scanning exposure device including a semiconductor laser and optical components such as a polygon mirror or a non-scanning exposure device including a light emitting diode and optical components.

The developing device 24 supplies a developer (toner), which is charged in a required polarity adaptive to the developing system, to a developing area opposed to the photoconductive body 21, so as to develop the electrostatic latent image. Examples of the developing device 24 include a two-component developing device for performing contact reversal development using a two-component developer containing a nonmagnetic toner and a magnetic carrier.

In the two-component developing device 24, a two-component developer is stored in a developer storage section of a device main body 24*a*. While the toner in the two-component developer is agitated with the carrier by a developer agitating/conveying member 24*b* which is disposed so as to rotate in the developer storage section, the developer is frictionally charged into a negative polarity. A cylindrical developing roll 24*c* for rotating with required magnetic poles being fixedly placed in its internal space is provided in an opening of the device main body 24*a* of the developing device 24. A part of the toner and the carrier in the developer storage section is retained by the developing roll 24*c* while forming an ear-rise-shaped magnetic brush by a magnetic force, and passes through a nip portion between the developing roll 24*c* and a layer regulating member 24*d* and is conveyed to the developing area opposed to the photoconductive body 21 in a state where a height of the toner is regulated to a required height (thickness).

The developing roll 24*c* is rotated in a required direction (for example, such a direction that, at a position opposed to the photoconductive body 21, the developing roll 24*c* moves in the same direction as the photoconductive body 21, for example) by power transmitted from a rotation driving device 28 including a motor. A developing voltage (developing bias) is applied to the nip portion between the developing roll 24*c* and the photoconductive body 21 from the developing power source (not shown). The rotation power of the developing roll 24*c* is also transmitted to the developer agitating/conveying member 24*b*. As the developing voltage, a voltage obtained by superposing an AC component on a DC component is applied.

The transfer device 25 finally transfers the toner image formed on the photoconductive body 21 onto a recording sheet 9. An example of the transfer device 25 applies a transfer voltage from the power source (not shown) to a transfer roll 25*a* which is disposed so as to come in contact with at least a charged area, in the rotation axis direction, of the photoconductive body 21 and to rotate. Examples of the transfer roll 25*a* include a roll obtained by forming an elastic layer made of a material such as rubber mixed onto a conductive core material. As the transfer voltage, a voltage having the opposite polarity to the charge polarity of the developer is applied. In this exemplary embodiment, the charge polarity of the developer is negative and thus, a DC voltage of the positive polarity is applied as the transfer voltage.

The sheet feeder 30 mainly includes a sheet storage body 31 and a feeding-out device 32. The sheet storage body 31 is attached to the casing 10 as it can be drawn therefrom and stores recording sheets 9 of any desired size, type, etc., in a stack state. The feeding-out device 32 feeds out the recording sheets 9 one by one from the sheet storage body 31. The recording sheet 9 fed out by the feeding-out device 32 from the sheet storage body 31 of the sheet feeder 30 is conveyed, through a sheet conveying passage 38 which is used to feed a sheet and includes (i) plural conveying roll pairs 33*a*, 33*b*, . . . installed between the feeding-out device 32 of the sheet feeder 30 and the transfer position of the image forming device 20 and (ii) a conveying guide member, to the transfer position between the photoconductive body 21 and the transfer device 25 in the image forming device 20.

The fixing device 40 is configured by providing a heating rotation body 42 and a pressing rotation body 43 in a casing 41. The heating rotation body 42 is in a roll form or a belt form, rotates in the direction indicated by the arrow, and has a surface temperature which is heated to and kept at a required temperature by a heating device. The pressing rotation body 43 is in a roll form or a belt form, comes in contact with the heating rotation body 42 at required pressure so as to be driven to follow almost in the rotation axis direction of the heating rotation body 42.

The controller 5 includes an arithmetic processing unit, a memory device, a control circuit, an external memory, an input/output unit and the like, and controls operations of the respective components of the image forming apparatus 1 in accordance with a control program stored in the memory device or the external memory.

The image forming apparatus 1 basically forms an image in the following manners.

When the image forming apparatus 1 receives an image forming (print) request, first, in the image forming device 20, the peripheral surface, which is used as the image formation effective area, of the photoconductive body 21 rotating in the direction indicated by the arrow A is charged to the required potential (charge potential) by the charging device 22. Then, a light beam LB based on image information (signal) is applied from the exposure device 23 to the charged peripheral surface of the photoconductive body 21. Thereby, an electrostatic latent image having a potential difference is formed on the peripheral surface of the photoconductive body 21. The charge potential in this exemplary embodiment is a potential of the negative polarity because the reversal development using the toner charged to the negative polarity is performed as described above. The electrostatic latent image is formed at a potential of the negative polarity (latent image potential) with the charge of the exposed portion being eliminated by the required amount.

Subsequently, in the image forming device 20, the electrostatic latent image formed on the photoconductive body 21 is (reversally) developed with the toner, which is charged to the negative polarity and is supplied from the developing roll 24*c* of the developing device 24, so as to form a toner image. The developing operation at this time is performed as follows. The developer (toner) forming a magnetic brush and retained on the developing roll 24*c* comes in contact with the peripheral surface of the photoconductive body 21, receives electrostatic attraction of a development field formed between the developing roll 24*c* and the photoconductive body 21 by the developing bias applied to the developing roll 24*c* and thus, is moved to the electrostatic latent image portion of the photoconductive body 21 and is electrostatically deposited. Then, the toner image is electrostatically transferred by the transfer device 25 onto the recording sheet 9, which is conveyed and fed into the transfer position between the photoconductive body 21 and the transfer device 25 from the sheet feeder 30. After the transfer, the cleaner 26 removes the unnecessary deposits, such as the toner, remaining on the peripheral surface of the photoconductive body 21.

The recording sheet 9 onto which the toner image is transferred in the image forming device 20 is peeled off from the peripheral surface of the photoconductive body 21 and then is conveyed to the fixing device 40. In the fixing device 40, the sheet 9 onto which the toner image is transferred is introduced into a contact part between the heating rotation body 42 and the pressing rotation body 43, and when the sheet 9 passes through the contact part, it is heated and pressed. Accordingly, the toner of the toner image is fused and fixed. Thereby, the toner image is fixed onto the sheet 9.

After completion of the fixing, the recording sheet 9 is discharged from the fixing device 40 and then is conveyed to a discharged sheet storage section 12 which is formed in a part of the casing 10 (in this example, an upper part of the casing 10). The sheet 9 discharged from the fixing device 40 is conveyed to the discharged sheet storage section 12, etc., through a sheet conveying passage which is used to discharge a sheet and includes plural sheet conveying roll pairs 34*a* and 34*b* and a conveying guide member. Forming of an image on (a single side) of the sheet 9 is now completed.

The image forming apparatus 1 of the exemplary embodiment 1 is configured to perform the following control so as to drive the developing roll 24*c* in the developing device 24 of the image forming device 20.

As shown in FIGS. 1 and 2, the image forming apparatus 1 includes a time detection counter 52 that detects information concerning a stop time period of the developing device 24 and a humidity sensor 54 which is provided in the casing 10 in which the image forming device 20 is provided and which measures a humidity. The image forming apparatus 1 selects, by the controller 5, control concerning drive of the developing roll 24*c* of the developing device 24 in accordance with results of the time detection counter 52 and the humidity sensor 54 before the developing device 24 starts the first developing operation after the developing device 24 stopped, and drives the developing roll 24*c* based on the selected control.

The time detection counter 52 stores a time at which a main power switch 56 of the image forming apparatus 1 is turned off and a time at which the switch is turned on, calculates a time period which has elapsed since the previous turning-off time when the main power switch 56 is turned on, and detects the elapsed time period as information concerning the stop time period of the developing device 24. If a relative humidity measured by the humidity sensor 54 becomes a setup value or more, the counter 52 measures the elapsed time period during a time in which the relative humidity is the setup value or more, and detects the elapsed time period as a piece of information concerning the stop time period of the developing device 24. Each of the elapsed time periods detected by the counter 52 is stored until the main power switch 56 is next turned on.

The humidity sensor 54 is disposed, for example, below the developing device 24 in the casing 10 and measures the relative humidity at its installation position. The humidity sensor 54 measures the relative humidity when the main power switch 56 is turned on. The relative humidity measured by the humidity sensor 54 is stored as information concerning the humidity.

The controller 5 is connected so as to obtain the measurement results of the time detection counter 52 and the humidity sensor 54 (information concerning the stop time period and information concerning the humidity) and is also connected so as to transmit a control signal (information) required for the rotation driving device 28 of the developing roll 24*c* of the developing device 24. The controller 5 performs control shown in FIG. 3 in accordance with the results of the time detection counter 52 and the humidity sensor 54 so as to drive and rotate the developing roll 24*c* before the developing device 24 starts the first developing operation after the developing device 24 stopped. Contents of the control, which is performed at this time (program and data), are stored in the memory device or the external memory of the controller 5.

Figure 3:
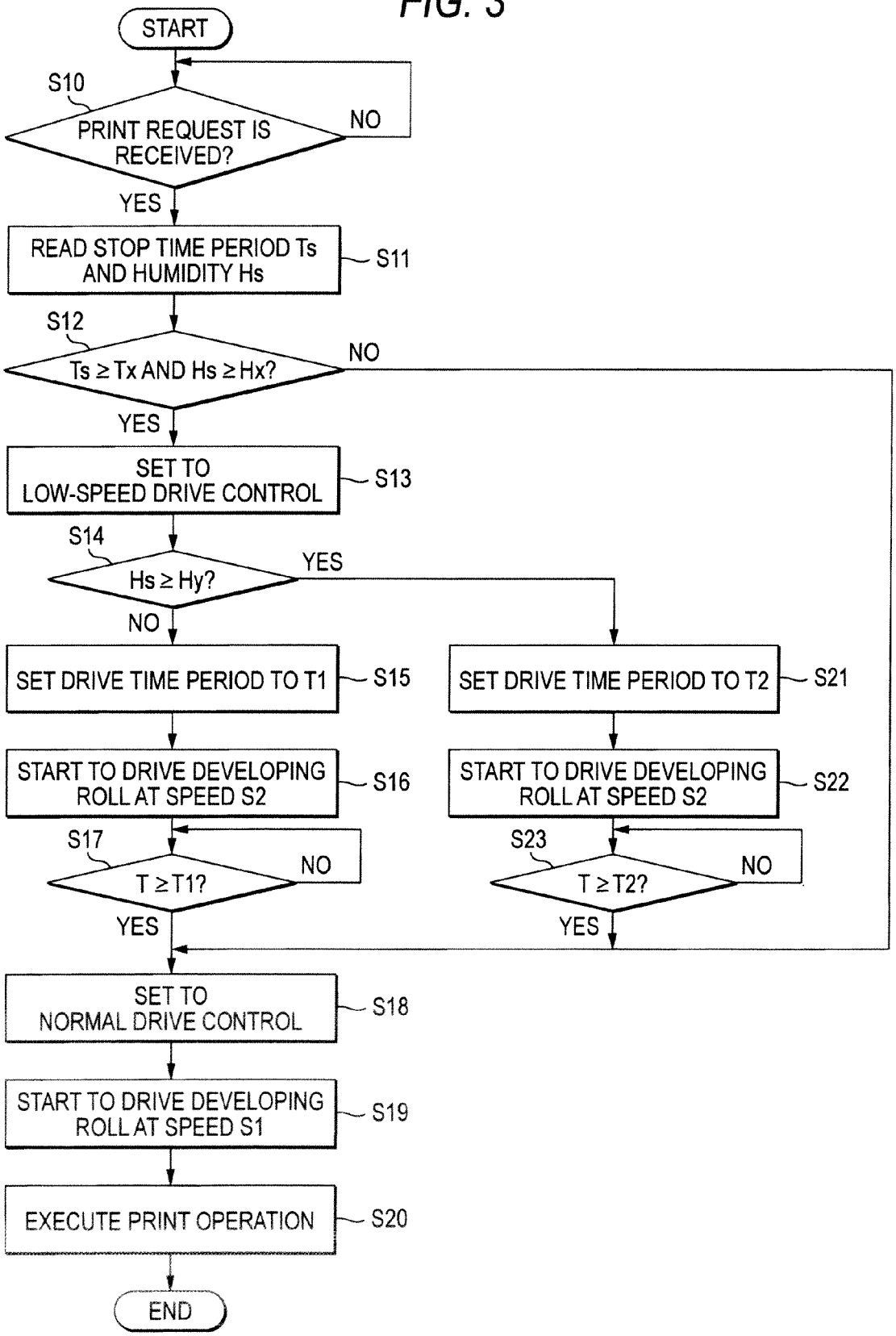
FIG. 3 is a flowchart to show control concerning drive of a developing roll.

The control operation of driving and rotating the developing roll by the controller 5 will be described below:

First, as shown in FIG. 3, when a print request is sent to the image forming apparatus 1, the controller 5 reads the information concerning the stop time period Ts of the developing device 24 detected by the time detection counter 52 and the information concerning the humidity Hs measured by the humidity sensor 54 (steps S10 and S11) and determines as to whether or not the information concerning the stop time period Ts of the developing device 24 is equal to or greater than a setup value (threshold value) Tx concerning a preset stop time period and the information concerning the humidity Hs is equal to or greater than a setup value Hx concerning a preset humidity (S12). With regard to the information concerning the humidity Hs, which is used in this determination, the result that the humidity Hs becomes equal to or greater than the predetermined setup value (Hx) is sent to the time detection counter 52. An elapsed time period since the humidity Hs becomes equal to or greater than the predetermined setup value (Hx) is set to the information concerning the stop time period of the developing device.

The stop time period Ts corresponds to an elapsed time period from a time when the last print operation of the image forming apparatus 1 is completed and the main power switch 56 is turned off to a time when the main power switch 56 is next turned on. The humidity Hs indicates variations in humidity after the expiration of the stop time period Ts. The setup value Tx concerning the stop time period is set to 10 hours, for example. The setup value Hx concerning the humidity is set to 70%, for example.

At this time, if the controller 5 determines that the stop time period Ts is less than the setup value Tx or that the humidity Hs is less than the setup value Hx or determines that the stop time period Ts is less than the setup value Tx and the humidity Hs is less than the setup value Hx, the controller 5 at least assumes that the image forming apparatus 1, particularly, the developing device 24 has not been left standing for a long time, and sets a drive mode of the developing roll 24*c* to a normal drive control mode (S18).

In this case, the developing roll 24*c* of the developing device 24 starts to drive at a normal-time rotation speed 51 by the rotation power transmitted from the rotation driving device 28 (S19). In this connection, the normal drive control controls the image forming apparatus so that the developing roll 24*c* is rotated at the normal-time rotation speed 51. The normal-time rotation speed is a speed that is applied when the image forming device 20 performs the image forming operation (particularly, its developing process).

On the other hand, if the controller 5 determines at step S12 that the stop time period Ts is equal to or greater than the setup value Tx and that the humidity Hs is equal to or greater than the setup value Hx, the controller 5 assumes that the image forming apparatus 1, particularly, the developing device 24 has been placed in a quiescent state for a comparatively long time and moreover has been placed in a comparatively high humidity environment, and sets the drive mode of the developing roll 24*c* to a low-speed drive control mode (S13). The low-speed drive control controls the image forming apparatus so that the developing roll 24*c* is rotated at rotation speed S2 (<S1), which is lower than the normal-time rotation speed 51, before the first print operation (containing the developing operation of the developing device 24) is started after the image forming apparatus stopped.

The low rotation speed S2 can be set considering a recovery condition of the charging performance (situation) provided by agitating the developer, a length (long or short) of the standby time until start of the next print operation, etc.; for example, the rotation speed S2 is set in the range of 0.4 to 0.8 times as long as the normal-time rotation speed 51. If the rotation speed S2 is smaller than 0.4 times the normal-time rotation speed S1 (lower limit value), there may arise a problem that the developer agitating time becomes long more than necessary, that the standby time until start of the next print operation becomes too long, etc., for example. Adjustment of the rotation speed is, for example, implemented by adjusting the drive speed of the motor of the rotation driving device 28 or if a mechanism for transmitting the motor power has a transmission speed adjusting function, by adjusting the transmission speed adjusting function of the transmission mechanism.

In this case, the controller 5 also determines as to whether or not the humidity Hs measured by the humidity sensor 54 is equal to or greater than a preset value Hy which is a determination criterion used to determine a drive time period T of the developing roll (S14). If the humidity Hs is smaller than the setup value Hy, the controller 5 sets a first drive time period T1 as the drive time period T; if the humidity Hs is equal to or greater than the setup value Hy, the controller 5 sets a second drive time period T2 (>T1), which is longer than the first drive time period T1, as the drive time period T (S16).

The setup value Hy is set as the determination criterion, which is used to determine as to whether or not it is necessary to adjust the drive time period T of the developing roll. A value of is the setup value Hy is set to a larger value than the setup value Hx used in determining as to whether or not the low-speed drive control is required (Hy>Hx). The reason why Hy is set larger than Hx is that as the developing device 24 stops longer in a higher-humidity environment, degradation of the charge characteristic (amount) of the toner contained in the developing device 24 becomes greater, and a defect of fogging, density change, etc., would easily occur in the first print operation (containing the developing operation), which is started after the image forming apparatus stopped and thus, it becomes necessary to more drive the developing roll when the humidity is higher. In this exemplary embodiment, the setup value Hy is set to 85%.

The first drive time period T1, which is used as the drive time period criterion, is set to be in a range of 30 seconds to 1 minute, for example. If the drive time period T1 is smaller than the lower limit of this range, there may arise a problem that the effect produced by the low-speed drive of the developing roll described later is not sufficiently provided. In contrast, if the drive time period T1 is greater than the upper limit of this range, there may arise a problem that the standby time until the first print operation is started after stop becomes long more than necessary. In addition, there may arise a problem that the developer is agitated for a long time more than necessary, and it is feared that unexpected degradation of the developer may occur. It is also feared that the unexpected degradation of the developer may occur likewise if the developing roll is rotated at higher speed than the normal-time rotation speed (high speed). Thus, for idle rotation of the developing roll 24*c*, it is advisable to rotate the developing roll at a lower speed than the normal-time rotation speed and also to set the rotation time period of the developing roll to the necessary minimum. In this exemplary embodiment, the setup value T1 is set to 1 minute. Further, the second drive time period T2 is set when the drive time period T needs to be adjusted; for example, the second drive time period T2 is set to a large value which is twice to three times the first drive time period T1. In this exemplary embodiment, the setup value T2 is set to 2 minutes.

After the drive time period T is set, the developing roll 24*c* is rotated only for a predetermined time period (T1 or T2) at the low speed S2 by the power transmitted from the rotation driving device 28 (S16 and S17 or S22 and S23). After the low-speed rotation of the developing roll is executed only for the predetermined time period, in either case, the mode is changed so that the control is set to the normal drive control (S18).

After the developing roll is rotated under the normal drive control or when the control mode is set to the low-speed drive control from the beginning, the developing roll 24*c* starts to rotate at the normal-time rotation speed S1 by the power transmitted from the rotation driving device 28 (S19) and then, the first print operation, which is requested after stop, is executed (S20).

In the first print operation after stop, occurrence of fogging caused by toner attached onto the background portion and occurrence of a density rise caused by excessive toner attached onto the photoconductive body are suppressed. Such an advantage can be provided without inducing secondary fault such as scattering of the toner of the developer in the casing 10, abrasion of the peripheral surface of the photoconductive body 21 caused by contact passage of the developer carried on the rotating developing roll 24*c* and the like.

The inventors estimate that the advantage is provided without inducing secondary fault for the following reason.

Even if the image forming apparatus 1, actually the developing device 24 is left standing in a stop state for a comparatively long time and in a high humidity environment and thus the toner of the developer stored in the developing device 24 absorbs moisture and its charge amount becomes smaller than the required charge amount, the low-speed drive control is executed before the first print operation, particularly, before the developing operation is started after long stop of the image forming apparatus. Accordingly, the developing roll 24*c* of the developing device 24 is driven only for the predetermined time period at the low speed S2. Consequently, a chance for the toner stored in the developing device 24 to come into contact with carrier and be frictionally charged before start of the print operation (containing the developing operation) is ensured, and the charge characteristic (amount) is recovered to the required level.

When the low-speed drive control is executed, the developing roll 24*c* rotates at the low speed S2, which is lower than the normal-time rotation speed S1. Accordingly, such a phenomenon is suppressed that the charge amount decreases because of the long stop time period in a high-humidity environment so that toner easy to detach from the developing roll

24*c*, etc., will actually detach. Moreover, since the developing roll 24*c* rotates at the low speed S2, when the developer carried in a state where it forms a magnetic brush on the developing roll 24*c* comes in contact with and passes through the peripheral surface of the photoconductive body 21, momentum of the developer when coming into contact with the photoconductive body 21 weakens, and the whole contact time period also shortens as the rotation speed is suppressed.

<Evaluation Test 1>

An evaluation test 1 conducted for the low-speed drive control in this exemplary embodiment will be described below:

In the evaluation test 1, when the left-standing time period (stop time period) after the developing device 24 stops reaches one hour, 10 hours, 20 hours, and 30 hours, test print based on a test chart containing a blank area is executed, and a toner fogging state on a sheet 9 which is obtained in each test print is examined. Leaving the image forming apparatus standing and the test print are executed in an environment where the temperature is 25 degrees and the relative humidity is 75% and in an environment where the temperature is 28 degrees and the relative humidity is 85%, separately.

A two-component developer containing a nonmagnetic toner (average particle diameter: 6.5 μm) and a magnetic carrier (average particle diameter: 35 μm) is used as the developer. The test prints are executed with the process speed (a rotation speed of the photoconductive body) being set to 103 mm/sec. While the rotation speed of the developing roll 24*c* in the normal drive control is 380 mm/sec, the rotation speed of the developing roll 24*c* in the low-speed drive control is set to 180 mm/sec. The low-speed drive time period in the low-speed drive control is set to 30 seconds.

Figure 4A:
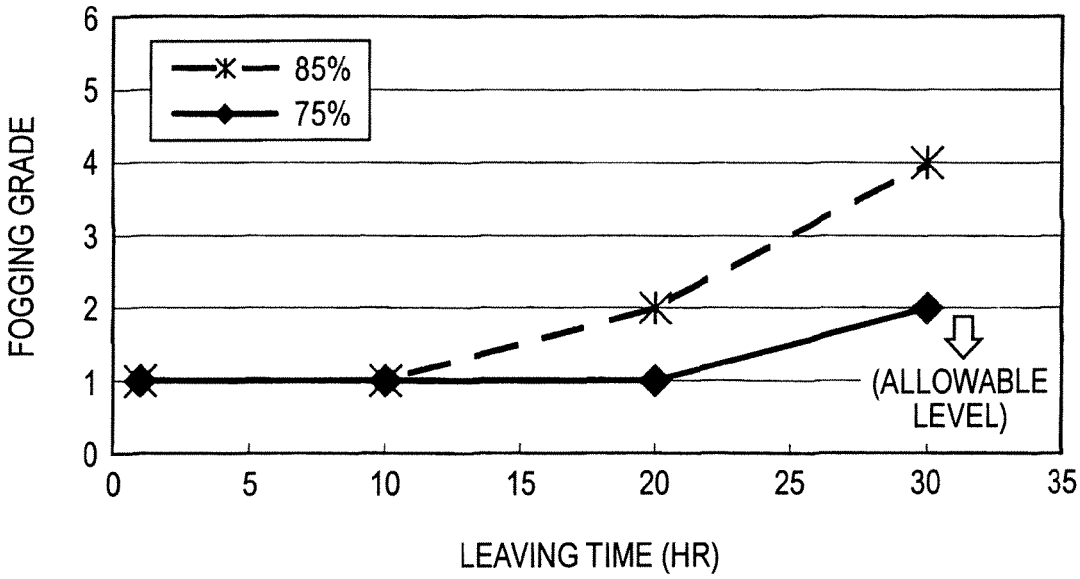
FIGS. 4A and 4B are graphs to show results of an evaluation test 1.

The obtained results are evaluated according to the following criterion. FIG. 4A shows the result.

Grade 1: No fog toner.

Grade 2: Existence of fog toner is recognized with a magnifier.

Grade 3: Existence of fog toner is slightly recognized by visual inspection.

Grade 4: Existence of fog toner is recognized by visual inspection.

Grade 5: Existence of much fog toner is recognized by visual inspection.

Grade 6: Existence of very much fog toner is recognized by visual inspection.

Figure 4B:
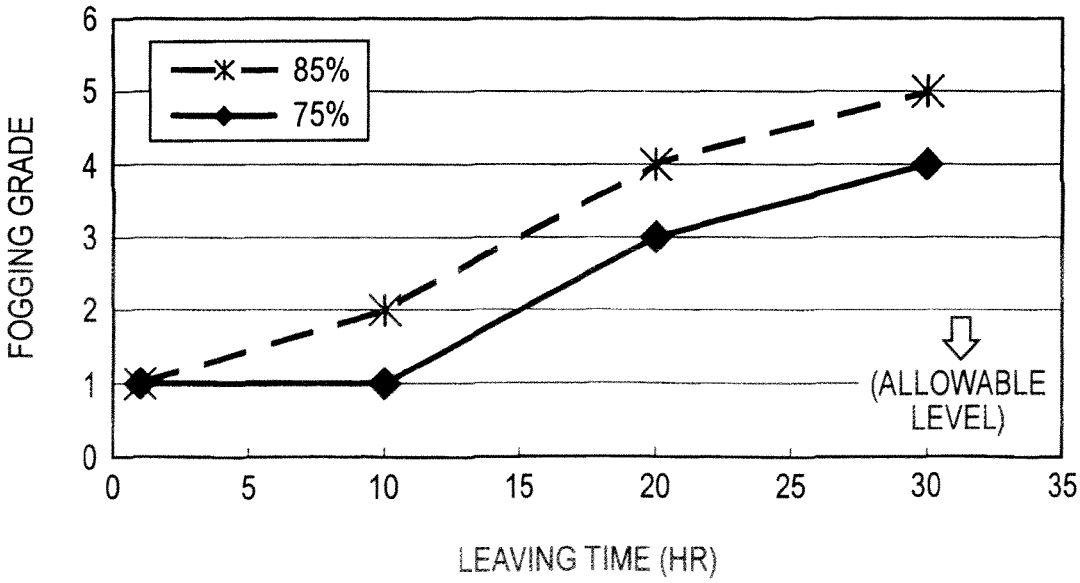

For comparison purposes, the toner fogging state when a test print is executed in the same condition without the low-speed drive control being performed after each left-standing time is examined FIG. 4B shows the evaluation result based on the same criterion.

[Modified Examples of Exemplary Embodiment 1]

The exemplary embodiment 1 described above illustrates the case where the elapsed time period from the turning-off operation of the main power switch 56 to the next turning-on operation is used as the information concerning the stop time period of the developing device. The information may be any time period so long as it is a time period from which a state where the developer in the developing device 24 is left standing over a comparatively long time can be known.

Examples of this information include an elapsed time period from a point in time such as (i) stop of the fixing device, (ii) stop of the developing operation, (iii) stop of rotation of the photoconductive body, (iv) stop of the charging operation, (v) stop of the transfer operation, or (vi) sheet discharge time to a point in time such as (vii) start of the next operation of the fixing device, (viii) start of the developing operation, (ix) start of rotation of the photoconductive body, (x) start of the charging operation, (xi) start of the transfer operation, or (xii) command reception of the image forming operation. In addition, in an image forming apparatus for making a transition to a mode (energy saving mode, sleep mode, etc.,) in which power consumption is reduced by lowering the heating state of the fixing device 40 after the expiration of a predetermined time period since completion of the print operation containing the image forming operation of the image forming device 20, the elapsed time period in this mode can be applied as the information concerning the stop time period. The elapsed time period until the print operation is first started after an operation of turning on the main power switch may also be used as the information concerning the stop time period.

The image forming apparatus 1 according to the exemplary embodiment 1 may be configured as follows: Even while the main power switch is turned off, the humidity sensor 54 is set to operate and measures the humidity every required time period until the next operation of turning on the main power switch 56, and an average value of the humidities is used as the information concerning the humidity. With this configuration, it becomes possible to know the actual humidity environment when the developing device actually stops for a long time and to perform more appropriate control (the low-speed drive control). On the other hand, if the time period in which the humidity is equal to or greater than the required setup value in the state where the main power switch is turned on is detected as in the example of the information concerning the humidity, which is described in the exemplary embodiment 1 and the elapsed time period is replaced with the information concerning the humidity, it becomes possible to switch appropriate control (low-speed drive control) in accordance with the charge state of the developer in a time zone close to the next started developing operation.

Also, when the main power switch 56 is turned on, it is expected that the image forming operation will be started later. Thus, it is also possible to set the image forming apparatus so as to previously execute the low-speed drive control at least one time in a time zone in which the first image forming operation has not actually been started. In this case, it may be possible to start the image forming operation immediately after a command of the first image forming operation actually is given (without performing the low-speed drive control).

If a situation where the humidity sensor 54 cannot measure humidity occurs, the image forming apparatus may be configured to execute the control operation with the setup value Tx of the stop time period or the setup value Hx of the humidity being changed later. That is, the setup value Tx of the stop time period or the setup value Hx of the humidity is temporarily changed to a looser value (lower value) than the initial value, and the determination step is executed. Accordingly, for example, in the period during which humidity cannot be measured, the risk of abrupt occurrence of a defect, such as fogging, if the humidity actually rapidly rises can be reduced.

Further, in the exemplary embodiment 1, the case in which the two-component developing device is used as the developing device 24 is illustrated. However, a mono-component developing device using a mono-component developer made of a toner component (limited to a device using a magnetic mono-component developer) may also be used as the developing device 24. To charge the mono-component developer in the mono-component developing device, the mono-component developer is frictionally charged mainly when it passes through the nip portion between a developing roller and a contact member fixedly provided in a contact state with the developing roller under pressure.

In addition, in the exemplary embodiment 1, the device, which transfers the toner image formed on the photoconductive body 21 directly onto the recording sheet 9, is illustrated as the image forming device 20. However, the image forming device 20 may adopt an intermediate transfer system. The image forming apparatus 1 may be one that forms a multicolor image (color image) made up of toner images of multiple colors formed with plural developing device storing developers of different colors.

[Exemplary Embodiment 2]

An image forming apparatus according to an exemplary embodiment 2 will be described. Members identical with those of the exemplary embodiment 1 are denoted by the same reference numerals and will not be described again in detail.

Figure 5:
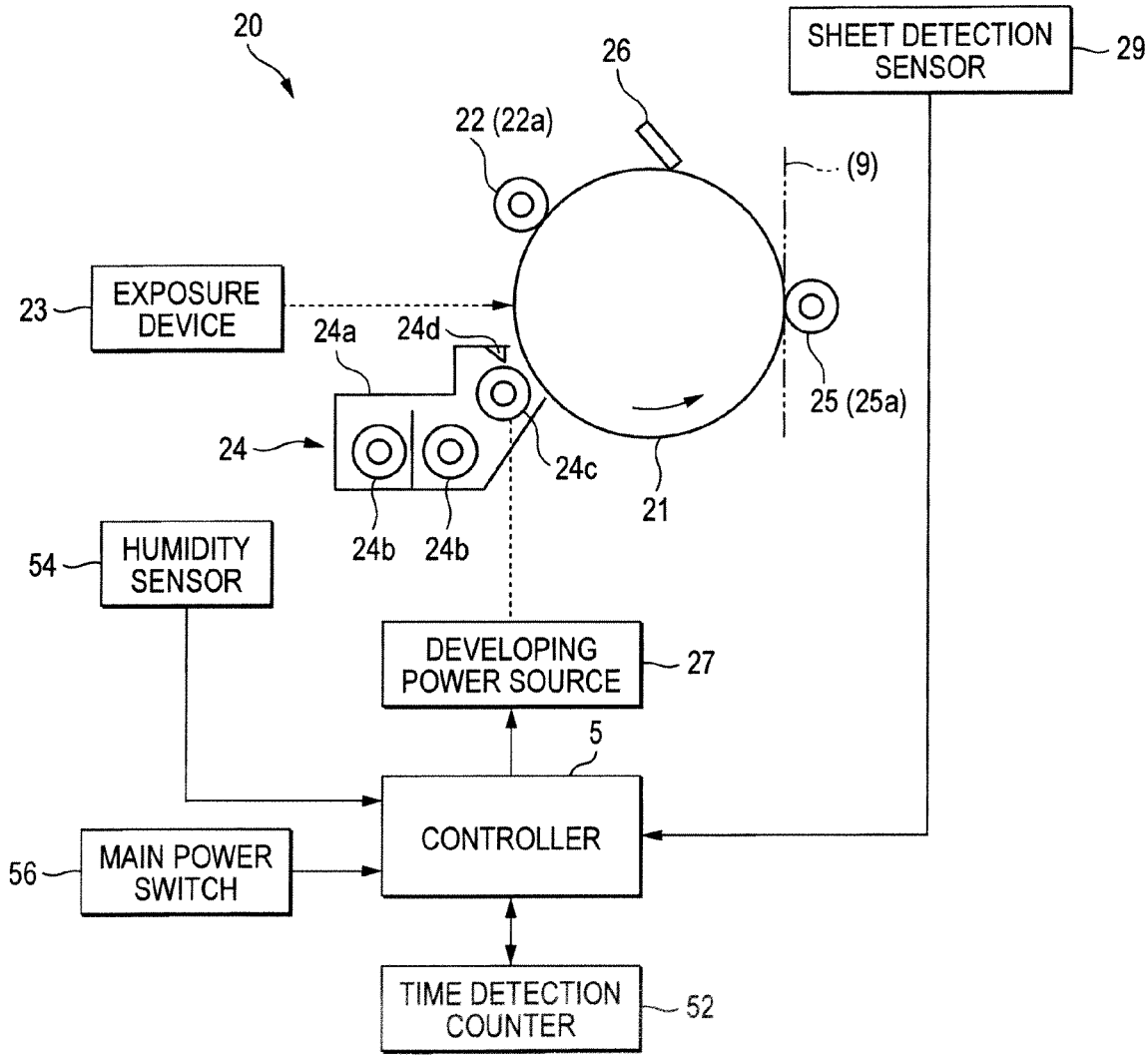
FIG. 5 is a schematic representation to show the configuration of a main control system of an image forming apparatus according to exemplary embodiments 2 and 3.

FIG. 1 also shows the outline of an image forming apparatus 1 according to the exemplary embodiment 2 of the invention. FIG. 5 shows a main part of the image forming apparatus 1 according to the exemplary embodiment 2 of the invention. The main part of the image forming apparatus 1 according to the exemplary embodiment 2 shown in FIG. 5 differs from that shown in FIG. 2 in that it includes a developing power source 27 in place of the rotation driving device 28.

The basic image forming processing of the image forming apparatus 1 according to Embodiment 2 is the same as that according to Embodiment 1 and therefore will not be described again.

The image forming apparatus 1 performs the following control for an AC component of a developing bias of a developing device 24 in an image forming device 20.

As shown in FIGS. 1 and 5, the image forming apparatus 1 includes a time detection counter 52 and a humidity sensor 54. The time detection counter 52 detects information concerning the stop time period of the developing device 24. The humidity sensor 54 is provided in a casing 10 in which the image forming device 20 is provided and measures humidity. The image forming apparatus 1 selects, by a controller 5, control regarding the AC component of the developing bias in the developing device 24 in accordance with information obtained by the time detection counter 52 and the humidity sensor 54 when the developing device 24 starts the first developing operation after the developing device 24 stops, and executes the image forming operation of the image forming device 20.

The time detection counter 52 stores a time when a main power switch 56 of the image forming apparatus 1 is turned off and a time when the main power switch 56 is turned on, calculates an elapsed time period since the previous turning-off time when the main power switch 56 is turned on, and detects the elapsed time period as information concerning the stop time period of the developing device 24. When the relative humidity measured by the humidity sensor 54 becomes a setup value or more, the counter 52 measures an elapsed time period in which the relative humidity is the setup value or more, and detects the elapsed time period as a piece of information concerning the stop time period of the developing device 24. Each of the elapsed times detected by the counter 52 is stored until the main power switch 56 is next turned on.

The humidity sensor 54 is provided, for example, below the developing device 24 in the casing 10 and measures the relative humidity at its installation position. The humidity sensor 54 measures the relative humidity when the main power switch 56 is turned on. The relative humidity measured by the humidity sensor 54 is stored as the information concerning the humidity.

The controller 5 is connected so as to obtain the measurement results of the time detection counter 52 and the humidity sensor 54 (the information concerning the stop time period and the information concerning the humidity) and is also connected so as to transmit a control signal (information) required for the rotation driving device 28 of the developing roll 24*c* of the developing device 24. The controller 5 performs control shown in FIGS. 5 and 6 for the AC component of the developing bias in accordance with the information obtained by both the time detection counter 52 and the humidity sensor 54 when the developing device 24 starts the first developing operation after the developing device 24 stops. Contents of the control performed at this time (program and data) are stored in a memory device or an external memory of the controller 5.

Figure 6:
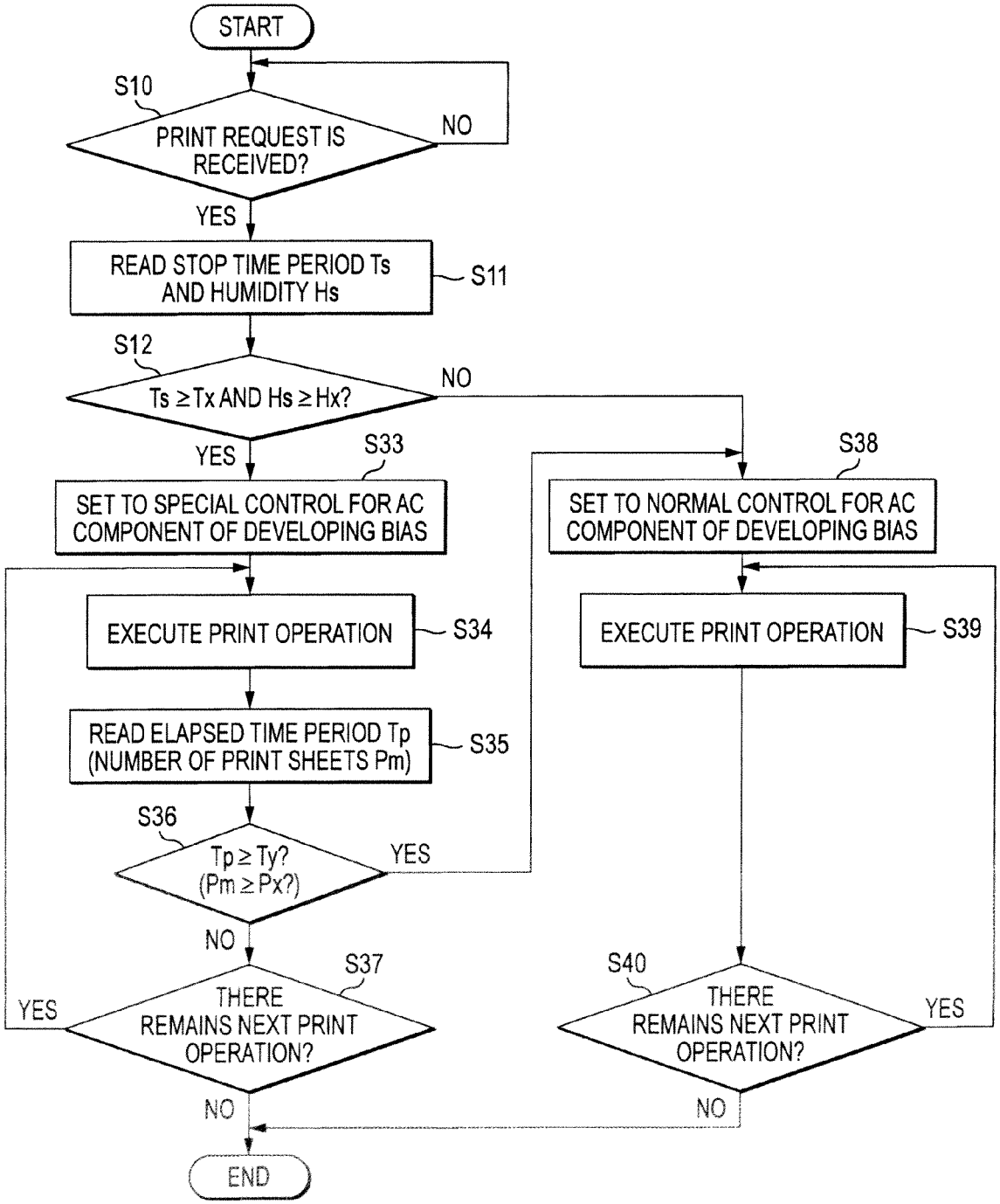
FIG. 6 is a flowchart to show control concerning a developing bias in an image forming operation.

The control operation relating to the developing bias of the controller 5 according to the exemplary embodiment 2 will be described below:

First, as shown in FIG. 6, when a print request is sent to the image forming apparatus 1, the controller 5 reads the information concerning the stop time period Ts of the developing device 24 detected by the time detection counter 52 and the information concerning humidity Hs measured by the humidity sensor 54 (steps S10 and S11) and determines as to whether or not the information concerning the stop time period Ts of the developing device 24 is equal to or greater than a setup value (threshold value) Tx concerning a preset stop time period and the information concerning the humidity Hs is equal to or greater than a setup value Hx concerning a preset humidity (S12). With regard to the information concerning the humidity Hs, which is used in this determination, the result that the humidity Hs becomes equal to or greater than the predetermined setup value (Hx) is sent to the time detection counter 52. An elapsed time period since the humidity Hs becomes equal to or greater than the predetermined setup value (Hx) is set to the information concerning the stop time period of the developing device.

The stop time period Ts corresponds to the elapsed time period until the main power switch 56 is next turned on since the main power switch 56 is turned off when the last print operation of the image forming apparatus 1 is completed. The humidity Hs indicates variations in the humidity after the expiration of the stop time period Ts. The setup value Tx concerning the stop time period is set to 15 hours, for example. The setup value Hx concerning the humidity is set to 60%, for example.

At this time, if the controller 5 determines that the stop time period Ts is less than the setup value Tx or that the humidity Hs is less than the setup value Hx or determines that the stop time period Ts is less than the setup value Tx and the humidity Hs is less than the setup value Hx, the controller 5 at least assumes that the image forming apparatus 1, particularly the developing device 24 has not been left standing for a long time, and sets a mode to a normal control mode for the AC component of the developing bias (S38). The normal control is as follows: The developing bias obtained by superposing an AC component on a DC component which is preset as a developing bias is applied, and the print operation (actually the developing operation) is started with the developing bias being applied.

In this case, the requested print operation is executed and is continued until completion of all the requested print operation (S39 and S40).

Figure 7:
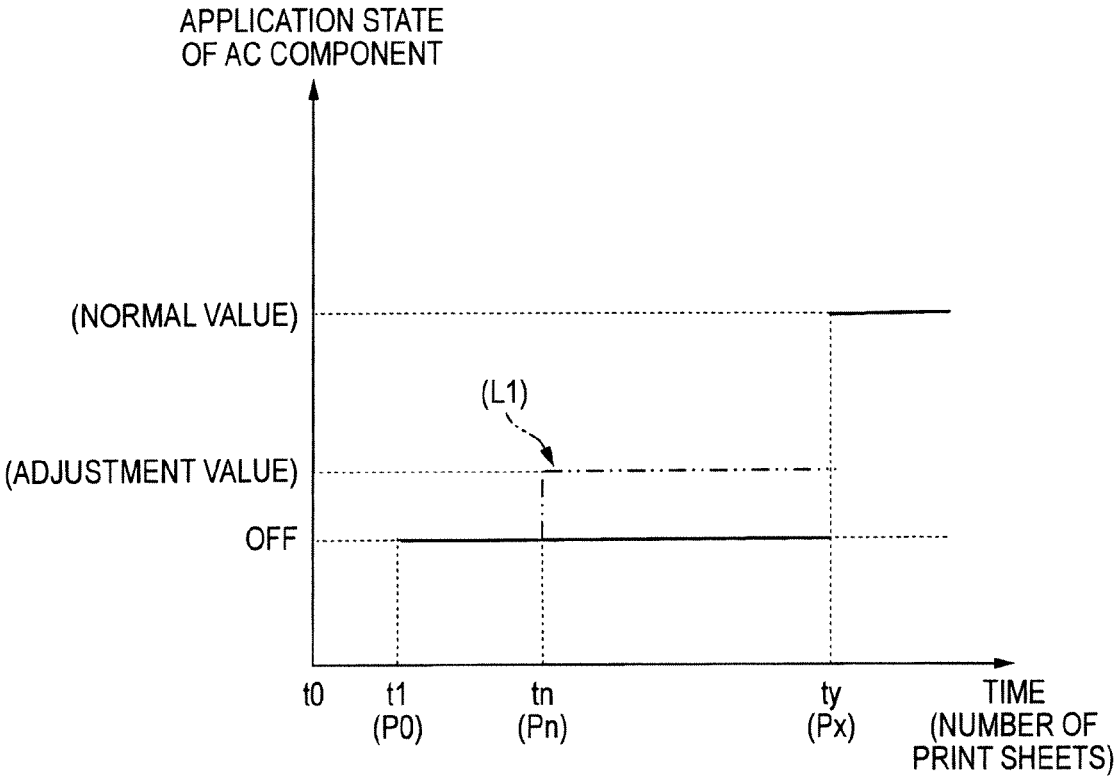
FIG. 7 is a schematic representation to show the configuration of special control of the developing bias (control of stopping applying of an AC component, etc.,) and normal control in the exemplary embodiment 2.

On the other hand, if the controller 5 determines at step S12 that the stop time period Ts is equal to or greater than the setup value Tx and the humidity Hs is equal to or greater than the setup value Hx, the controller 5 assumes that the image forming apparatus 1, particularly the developing device 24 has been placed in a quiescent state for a comparatively long time and moreover has been placed in a comparatively high humidity environment, and sets the mode to a special control mode for the AC component of the developing bias (S33). The special control in this exemplary embodiment is as follows. As shown in FIG. 7, when the first print operation (containing the developing operation of the developing device 24) is started after the image forming apparatus stopped, the image forming operation (actually the developing operation) is started in a state where it is stopped to apply the AC component of the developing bias.

Subsequently, the requested print operation is executed (S34). In the print operation, the DC component (dc voltage: Vcd) is applied as the developing bias from the developing power source 27 to the developing roll 24*c* of the developing device 24 in the developing process of the image forming device 20. In FIG. 7, "t1" on the horizontal axis indicates a point in time at which it is started to apply the developing bias under the special control in the first print operation, which is started after the image forming apparatus stopped.

The developing operation at this time is performed by having a toner charged to a negative polarity be electrostatically attracted to a portion of an electrostatic latent image at a potential lower than (close to the zero potential) the charge potential of the negative polarity in a state where only an electric field of a DC component is formed between the developing roll 24*c* and the photoconductive body 21. That is, in the developing process at this time, an alternating electric field of an AC component is not formed between the developing roll 24*c* and the photoconductive body 21 and accordingly, the transferring motion of the toner to the photoconductive body 21 lessens, and the developing performance is degraded as a whole.

As a result, if the image forming apparatus 1 is left standing for a comparatively long time and in a high humidity environment and thus the toner of the developer stored in the developing device 24 absorbs moisture and its charge amount becomes smaller than the required charge amount, no AC component is applied as the developing bias in the developing process of the print operation, which is started after the long stop. Therefore, a phenomenon that the toner is peeled off from the carrier because of the alternating electric field becomes hard to occur and a state where the toner floats and moves freely in a developing area where the developing roll 24*c* is opposed to the photoconductive body 21 (so called, cloud state) becomes hard to occur. Thus, successive toner is not attached onto the electrostatic latent image portion (image portion) on the photoconductive body, and the amount of the toner charged to the opposite polarity also decreases, so that the amount of the toner, which has the opposite polarity and is attached onto the background portion on the photoconductive body, also decreases. Accordingly, in the print operation after the long stop, occurrence of fogging caused by toner attached onto the background portion and occurrence of a density rise caused by excessive toner attached onto on the image portion are suppressed.

In this connection, in the developing process at the normal time, when a developing bias containing an AC component is applied, the toner is peeled off from the carrier because of the alternating electric field and is attached onto the electrostatic latent image portion on a photoconductive body. Accordingly the charge is neutralized, and the developing operation is completed. However, if it is assumed that the image forming apparatus 1 has been placed in a quiescent state for a comparatively long time and moreover has been placed in a comparatively high humidity environment as described above, the toner becomes a low charge state, and the amount of the toner required for neutralization increases. Thus, the toner attached onto the electrostatic latent image portion on the photoconductive body becomes excessive. Also, if the charge of the toner decreases, the charge distribution also shifts to the lower side. Thus, the amount of the toner charged to the opposite polarity increases, and the toner charged to the opposite polarity is attached onto the background portion on the photoconductive body (is normally developed), which results in occurrence of fogging.

An elapsed time period Tp since a point in time when the main power switch 56 is turned on (t0) is read out during the print operation (print operation on one recording sheet), and it is determined as to whether or not the elapsed time period Tp is equal to or greater than a preset value Ty concerning the elapsed time period (S35 and S36).

The elapsed time period Tp is measured by the time detection counter 52, which measures the stop time period Ts, for example. The setup value Ty is set to three hours, for example.

At this time, when the elapsed time period Tp does not reach the setup value Ty, there remains a requested print operation. Then, the next print operation is repeated in a similar manner under the special control, and the elapsed time period Tp is checked in a similar manner (S37→S34 and S34 to S36).

On the other hand, if the elapsed time period Tp becomes equal to or greater than the setup value Ty, the controller 5 assumes that the charging performance (amount) of the toner of the developer is recovered, and changes the mode setting for the AC component of the developing bias from the special control mode to the normal control mode (S38). In this case, in the developing process of the later executed print operation, a developing bias obtained by superposing an AC component on a DC component is applied as shown in FIG. 7. The AC component applied at this time becomes the same normal value as the AC component applied in the normal control.

The exemplary embodiment 2 illustrates the case where the information of the elapsed time period Tp is used as information for switching from the special control to the normal control for the AC component of the developing bias. Instead, information of a cumulative number of times Pm of the print operation (S34), which is started after long stop (the number of times of print operation on one recording sheet: Number of print sheets), may also be used (see FIGS. 6 and 7).

In this case, as the number of print sheets, Pm, a number-of-sheets counter (not shown) cumulatively counts detection information of a sheet detection sensor 29 that detects that a post-fixed recording sheet 9 passes when the recording sheet is discharged to a discharged sheet storage section 12, for example. The controller 5 determines as to whether or not the number of print sheets, Pm, is equal to or greater than a preset value Px during the print operation, which is started after stop. If the number of print sheets, Pm, becomes equal to or greater than the setup value Px, the controller 5 changes the mode setting for the AC component of the developing bias from the special control mode to the normal control mode (S36→S38 in FIG. 6). The setup value Px is set to 2,000 sheets for the print operation for a JIS A4-size (transverse feed) recording sheet 9, for example. In FIG. 7, "t0" on the horizontal axis indicates a point in time at which the number of print sheets, Pm, is equal to 0.

The exemplary embodiment 2 shows the control of continuing to stop applying of the AC component of the developing bias until the timing at which the special control is switched to the normal control (the timing at which Tp≧Ty or Pm≧Px) comes after the mode is set to the special control for the AC component of the developing bias (see FIG. 7). However, the image forming apparatus may be configured to execute control of applying an adjustment value different from the normal value as the AC component after a required time tn has elapsed since the print operation is started after long stop as indicated by the alternate long and two short dashes line in FIG. 7.

In this case, the required time tn may be set to a time until the elapsed time period since the start time point of the print operation, which is started after long stop (for example, from the start point of applying a developing bias in special control (t1) to a point in time at which the number of print sheets reaches required setup value (tn, Pn). In this connection, the setup values (tn and Pn) are set to smaller values than the setup values Ty and Px of the elapsed time period Tp and the number of print sheets, Pm, used as information for switching from the special control to the normal control.

In this case, the adjustment value of the AC component is set so that a peak-to-peak voltage of the AC voltage (Vpp: See FIG. 8) becomes a smaller value than a peak-to-peak voltage of the AC voltage at the normal time (Vpp) (preferably, a value of less than a half of the peak-to-peak voltage at the normal time), for example.

Further, the AC component of the adjustment value is continuously applied until the special control is switched to the normal control, as indicated by an alternate long and two short dashes line L1 in FIG. 7. When the AC component of the adjustment value is applied continuously, there is the advantage that the control operation and the detection operation are facilitated, and degradation of the productivity concerning the print operation is lessened, etc. The AC component of the adjustment value may be intermittently applied until the special control is switched to the normal control. Intermittent applying means applying the AC component of the adjustment value in a state indicated by a straight line or a quadratic curve, for example. When the AC component is applied intermittently, the applying timing (applying interrupt timing) may be set using density information provided by automatic density control (ADC) for forming a toner image for control, actually measuring the density of the toner image, and controlling the image density based on the measured density information, for example. When the AC component of the adjustment value is applied intermittently, there is the advantage that an appropriate AC component responsive to the charge amount of the developer each time can be applied, and that occurrence of fogging and occurrence of a density rise are suppressed more appropriately, etc.

[Exemplary Embodiment 3]

Figure 9:
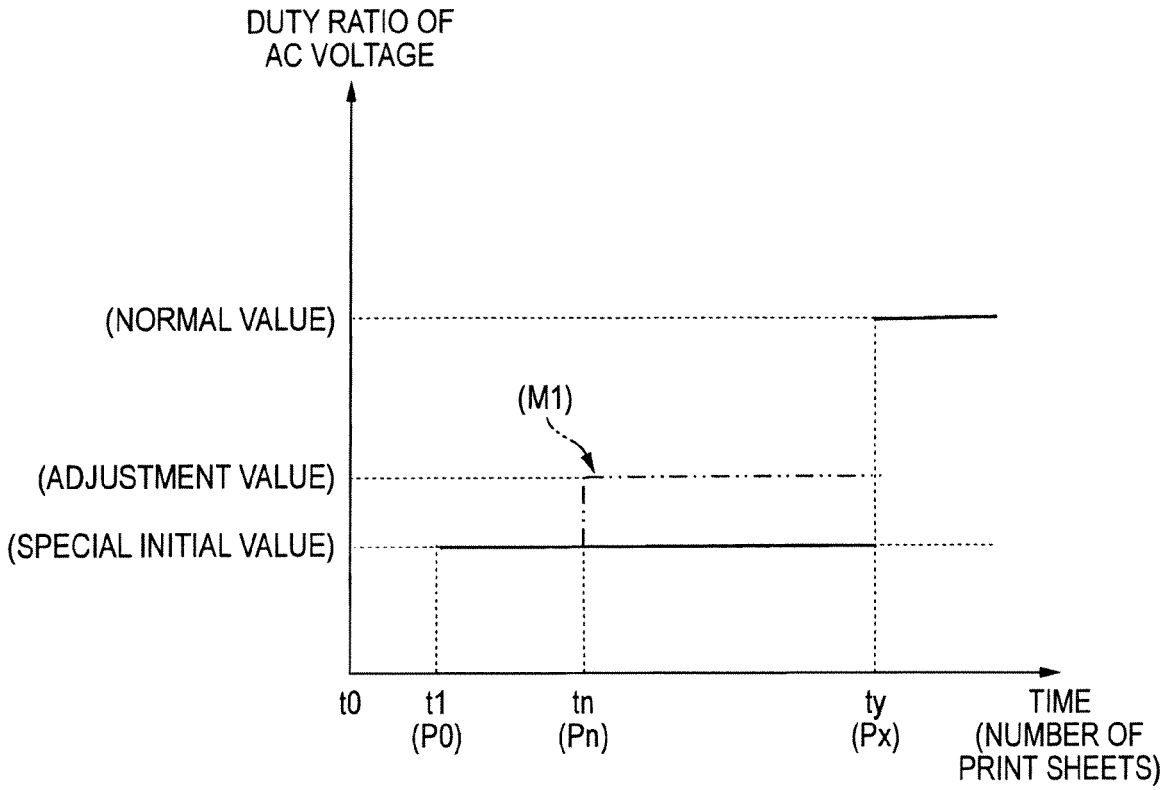
FIG. 9 is a schematic representation to show the configuration of special control of the developing bias (control of changing a duty ratio of the AC component, etc.,) and normal control in the exemplary embodiment 3.

FIGS. 8 and 9 show other configuration examples of the special control for the AC component of the developing bias executed by a controller 5 in an image forming apparatus 1 according to an exemplary embodiment 3.

The special control according to the exemplary embodiment 3 is as follows. As shown in FIG. 8, a duty ratio (D) of a voltage waveform of an AC component of a developing bias is changed to a value (D'=T1'/T) where a ratio of a waveform portion (T1) forming an electric field for attracting a toner of a developer from a developing roller 24*c* to a photoconductive body 21 becomes smaller (T1') than T1 of a value at the normal time (D=T1/T), and the image forming operation is started.

FIG. 8 shows voltage waveforms of AC voltages Vac and Vac' of the developing bias in the normal control and the special control, and waveforms of DC voltage Vdc. In the figure, the symbol T indicates one period of the waveform of the AC voltage, and the symbol T2 (T2') indicates a waveform portion forming an electric field for attracting toner from the photoconductive body 21 to the developing roller 24*c*.

If the controller 5 of the exemplary embodiment 3 does not determine at step S12 shown in FIG. 6 that the stop time period Ts is equal to or greater than the setup value Tx and the humidity Hs is equal to or greater than the setup value Hx, the controller 5 sets the mode to the normal control mode for the AC component of the developing bias (S38).

The normal control is as follows. As shown in the upper part of FIG. 8, the developing bias obtained by superposing an AC voltage at the normal-time duty ratio (D=T1/T) on a normal-time DC voltage Vdc is applied, and the print operation is started with the developing bias being applied. The normal-time duty ratio (D=T1/T) is set to a value exceeding 50% (D>50%) so that the ratio of the waveform portion (T1) forming to electric field for attracting the toner from the developing roller 24*c* to the photoconductive body 21 becomes larger than the ratio of the opposite waveform portion (T2), for example. In this exemplary embodiment, D is set to 70%, for example.

In the developing process in the print operation, which is executed with the mode being set to the normal control, the voltage on which the AC voltage at the normal-time duty ratio (D=T1/T) is superposed is applied as the developing bias. Thereby, the toner receives an action of the electric field for attracting the toner from the developing roller 24*c* to the photoconductive body 21, and good developing is achieved at the normal time.

On the other hand, if the controller 5 determines at step S12 that the stop time period Ts is equal to or greater than the setup value Tx and the humidity Hs is equal to or greater than the setup value Hx, the controller 5 sets the mode to the special control mode for the AC component of the developing bias in the developing device 24 (S33).

In the special control, the developing bias obtained by superposing an AC voltage at a duty ratio which is a special initial value (D'=T1'/T) on the normal-time DC voltage Vdc is applied from a developing power source 27 as shown in the lower part of FIG. 8 and FIG. 9, and the print operation is started with the developing bias being applied. In FIG. 9, "t1" on the horizontal axis indicates a point in time at which the developing bias under the special control is applied in the first print operation, which is started after the image forming apparatus stopped.

The duty ratio, which is the special initial value (D'=T1'/T), is set to a small value of 50% or less (D≦50%) so that the ratio of the waveform portion (T1) forming the electric field for attracting the toner from the developing roller 24*c* to the photoconductive body 21 becomes smaller than the ratio of the opposite waveform portion (T2). In this exemplary embodiment, D' is set to 30%, for example.

The developing at this time is executed by having the toner, which is charged to the negative polarity, be electrostatically attracted to the electrostatic latent image portion in a state where the ratio of the electric field for attracting the toner formed between the developing roll 24*c* and the photoconductive body 21 from the developing roll 24*c* to the photoconductive body 21 lessens and the ratio of the electric field for attracting the toner from the photoconductive body 21 to the developing roll 24*c* increases. That is, in the developing process at this time, the ratio of the toner receiving the action of the electric field for attracting the toner from the developing roller 24*c* to the photoconductive body 21 decreases and accordingly, the motion of the toner making a transition to the photoconductive body 21 weakens, and the developing performance is degraded as a whole.

As a result, if the image forming apparatus 1 is left standing for a comparatively long time and in a high humidity environment and thus the toner of the developer stored in the developing device 24 absorbs moisture and the charge characteristic (amount) becomes lower than the required charge characteristic, the state becomes the same as the developing process under the special control as in the exemplary embodiment 2 in the developing process of the print operation, which is started after the long stop. In the print operation, which is started after the long stop, occurrence of fogging caused by toner attached onto the background portion and occurrence of a density rise caused by excessive toner attached onto the image portion of the photoconductive body 21 are suppressed as in the case where the special control is executed in the exemplary embodiment 2.

During the print operation, the elapsed time period Tp since the point in time (t0) at which the main power switch 56 is turned on is also read out, and it is determined as to whether or not the elapsed time period Tp is equal to or greater than the preset value Ty concerning the elapsed time period is also determined (S35 and S36 in FIG. 6) as with the case under the special control in the exemplary embodiment 2.

Particularly, at this time, when the elapsed time period Tp becomes equal to or greater than the setup value Ty, the controller 5 assumes that the charging performance (amount) of the toner of the developer is recovered, and changes the mode setting for the AC component of the developing bias from the special control to the normal control mode (S38). In this case, in the developing process of the later executed print operation, the voltage on which the ac voltage at the duty ratio of the ordinary value (D=T1/T) is superposed is applied as the developing bias, as shown in FIG. 9.

In the exemplary embodiment 3, the cumulative number of times Pm of the print operation (S34), which is started after long stop may also be used as information for switching from the special control to the normal control for the AC component of the developing bias, as previously described with reference to FIGS. 6 and 7 in the exemplary embodiment 2.

The exemplary embodiment 3 also shows the control of continuing to apply the voltage on which the AC voltage at the duty ratio of the special initial value (D'=T1'/T) is superposed as the developing bias until the timing at which the special control is switched to the normal control (the timing at which Tp≧Ty or Pm≧Px) comes after the mode is set to the special control for the AC component of the developing bias (see FIG. 9). However, the image forming apparatus may be configured to execute control of superposing an adjustment value at a duty ratio (D") different from the duty ratio of the ordinary value (D) as the AC voltage and applying after the required time to has elapsed since the print operation is started after long stop as indicated by the alternate long and two short dashes line in FIG. 9.

In this case, the duty ratio of the adjustment value (D") may be less than 70%; for example, it is set to a value (D"=T1"/T) where the ratio of the waveform portion (T1) forming the electric field for attracting the toner from the developing roller 24*c* to the photoconductive body 21 becomes larger than the duty ratio of the special initial value (D') first changed at the special control time. The waveform portion T1" in the adjustment value is a value larger than the waveform portion (T1') at the duty ratio of the special initial value and is a value smaller than the waveform portion (T1) at the normal-time duty ratio (T1>T1">T1').

Further, the voltage on which the AC component at the duty ratio of the adjustment value (D") is superposed is continuously applied until the special control is switched to the normal control as indicated by an alternate long and two short dashes line M1 in FIG. 9. When the AC component of the adjustment value is applied continuously, there is the advantage that the control operation and the detection operation are facilitated, and degradation of the productivity concerning the print operation is lessened, etc. The AC component of the adjustment value may be applied stepwise until the special control is switched to the normal control. Stepwise applying means applying the AC component of the adjustment value in a state indicated by a straight line or a quadratic curve, for example. When the AC component is applied stepwise, the applying timing (applying interrupt timing) may be set using density information provided by automatic density control (ADC) as mentioned above, for example. When the AC component of the adjustment value is applied stepwise, there is the advantage that an appropriate AC component responsive to the charge amount of the developer each time can be applied, and occurrence of fogging and occurrence of a density rise are suppressed more appropriately, etc.

<Evaluation Tests>

Evaluation tests 2 and 3 conducted for the special control in the exemplary embodiments 2 and 3 will be described below:

Each of the evaluation tests 2 and 3 is conducted using a tandem image forming apparatus in which four image forming devices are provided in series to form toner images of four colors of yellow (Y), magenta (M), cyan (C), and black (K), and the color toner images is transferred onto a recording sheet directly or through an intermediate transfer body, and finally a single-color or multicolor image provided by combining the color toner images is formed appropriately. In each of the evaluation tests 2 and 3, a given image (toner image having an image density 5% for each color) is previously formed on 10×1,000 (=10 kPV) recording sheets using the image forming apparatus and then, the image forming apparatus is left standing for 48 hours in an environment where the temperature is 28 degrees and the humidity is 85% RH.

Figure 10:
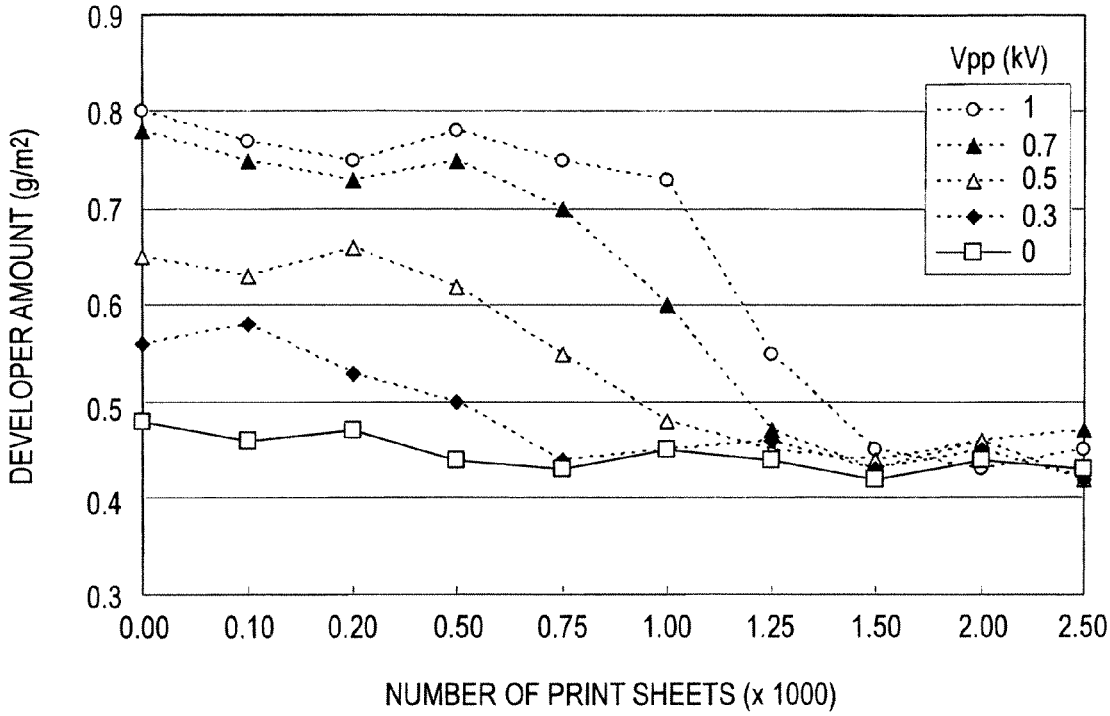
FIG. 10 is a graph to show a test result concerning rise-suppression effect of an image density in an evaluation test 2.
Figure 11:
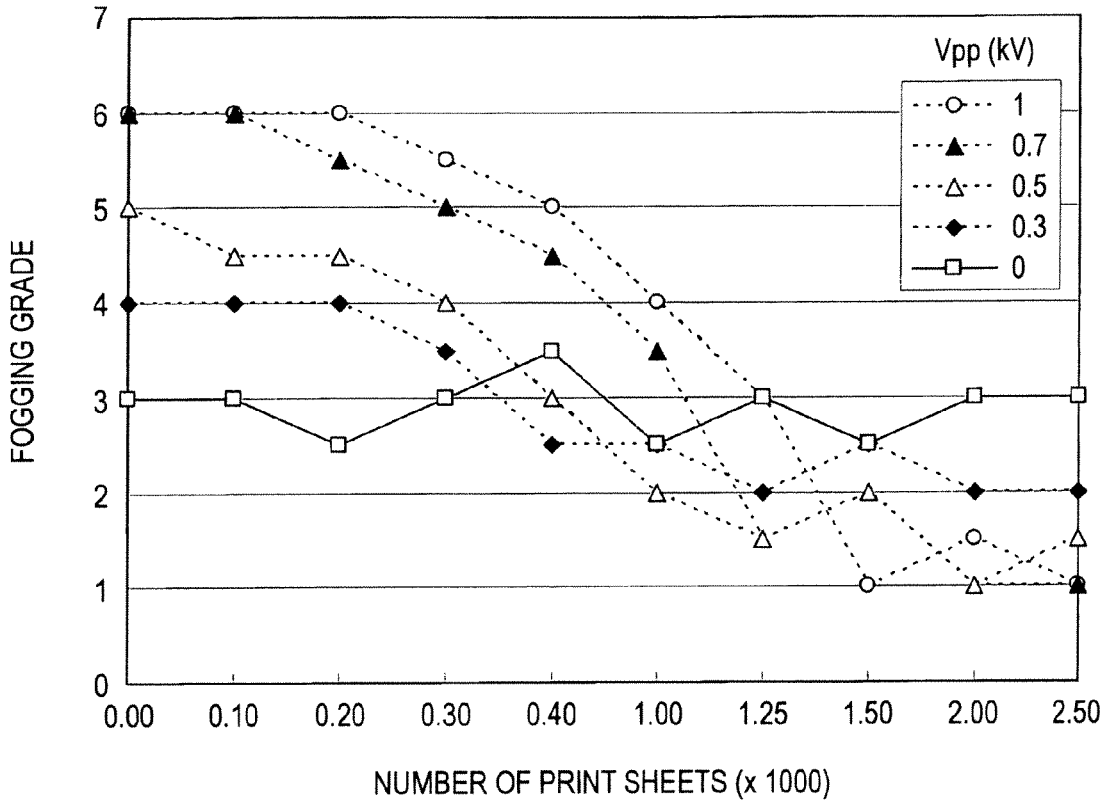
FIG. 11 is a graph to show a test result concerning a fogging-suppression effect in the evaluation test 2.

In the evaluation test 2, using the image forming apparatus after left standing, the same image forming operation is performed for as many recording sheets as the reference number of print sheets shown in FIGS. 10 and 11 under the same condition as that before the image forming apparatus is left standing while each peak-to-peak voltage (Vpp) as shown in FIGS. 10 and 11 is applied as the AC voltage of the developing bias. Then, whenever it is completed to form an image on as many recording sheets as the reference number of print sheets, a developer weight per unit area in the image portion on the photoconductive body 21 is measured, and the attachment state of the developer per unit area in the background portion on the photoconductive body 21 is observed. FIGS. 10 and 11 show the results.

The rise suppression result of the image density was evaluated from the difference from the target value of the developer weight in the image portion. A target value of the developer weight in the image portion of the image density mentioned above is 0.42 to 0.47 g/m$^2$. The fogging-suppression effect is evaluated with respect to the fogging grade in the following criterion in response to the attachment state of the developer on the background portion and is evaluated based on a difference from the allowable value of the grade. As the grade becomes a value closer to "1," it means that toner attached onto the background portion does not exist or only a smaller amount of toner exists to such an extent that it can be recognized as it is enlarged with a magnifier; it is ranked as a good result with no practical problem. In contrast, as the grade becomes a value closer to "7," it means that a larger amount of toner attached onto the background portion is recognized; it is ranked as a poor result involving a practical problem. The allowable value of the grade is "grade 3 or less." In this connection, the inventors acknowledges that the effect on the whole image quality can be lessened if the peak-to-peak voltage (Vpp) of the AC voltage of the developing bias in the image forming device 20M for magenta (M) is controlled and switched in the image forming apparatus.

Figure 12:
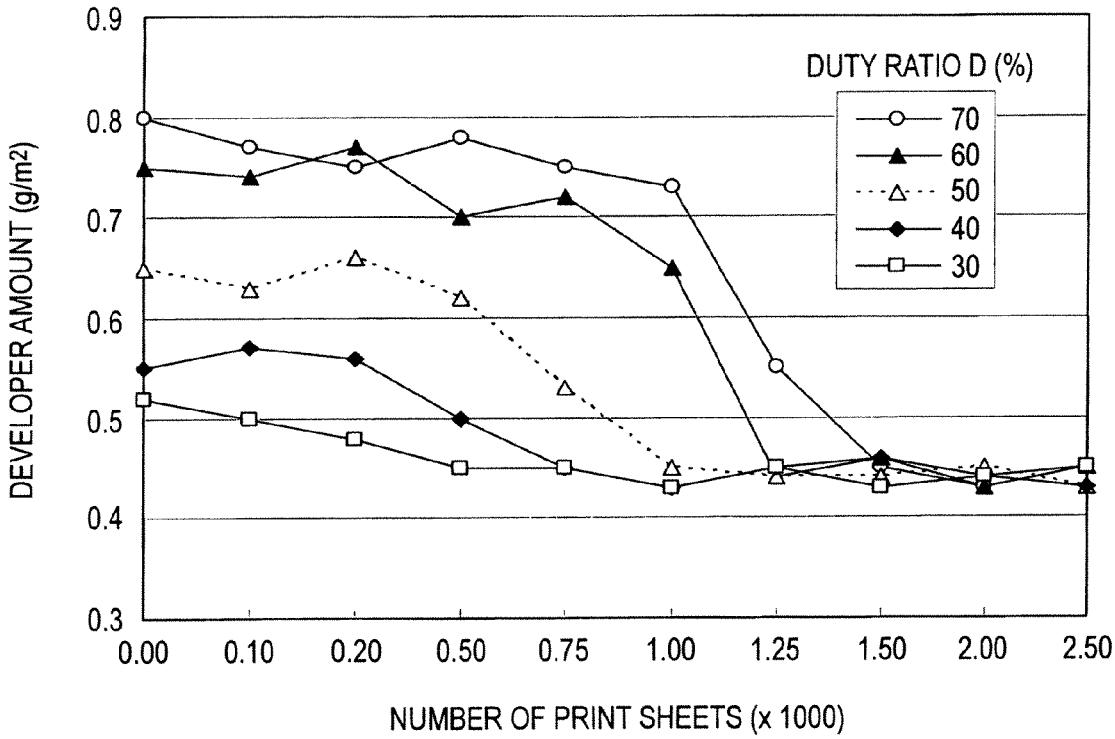
FIG. 12 is a graph to show a test result concerning the rise-suppression effect of an image density in an evaluation test 3.
Figure 13:
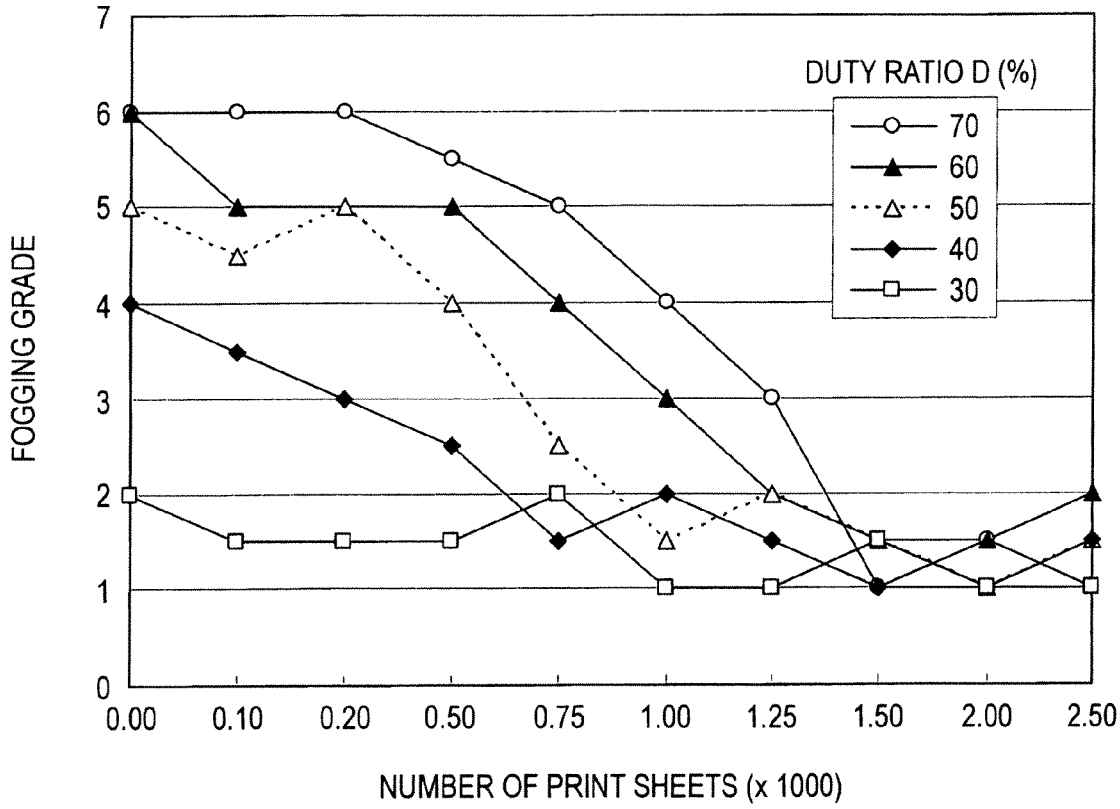
FIG. 13 is a graph to show a test result concerning the fogging-suppression effect in the evaluation test 3.

In the evaluation test 3, using the image forming apparatus after left standing, an image is formed under the same condition as that before the image forming apparatus is left standing for as many recording sheets as the reference number of print sheets shown in FIGS. 12 and 13 while a voltage at each duty ratio (D) shown in FIGS. 12 and 13 is applied as the AC voltage of the developing bias. Then, whenever it is completed to form an image on as many recording sheets as the reference number of print sheets, the developer weight is measured, and the attachment state of the developer is observed as in the evaluation test 2. FIGS. 12 and 13 show the results. An effect of suppressing a rise of the image density and the fogging-suppression effect are evaluated in a similar manner to that of the evaluation test 2.

[Modified Examples of Exemplary Embodiments 2 and 3]

The exemplary embodiments 2 and 3 described above illustrate the case in which the elapsed time period from the operation of turning off the main power switch 56 to the next turning-on operation is used as the information concerning the stop time period of the developing device. Any time may be adopted as this information so long as it is a time from which a state where the developer in the developing device 24 is left standing over a comparatively long time can be known.

For example, examples of this information may include an elapsed time period from a point in time such as (i) stop of the fixing device, (ii) stop of the developing operation, (iii) stop of rotation of the photoconductive body, (iv) stop of the charging operation, (v) stop of the transfer operation or (vi) sheet discharge time to a point in time such as (vi) start of the next operation of the fixing device, (vii) start of the developing operation, (viii) start of rotation of the photoconductive body, (ix) start of the charging operation, (x) start of the transfer operation, or (xi) command reception of the image forming operation. In addition, in an image forming apparatus for making a transition to a mode of decreasing power consumption (energy saving mode, sleep mode, etc.,) by lowering the heating state, etc., of the fixing device 40 after the expiration of a predetermined time period since completion of the print operation containing the image forming operation of the image forming device 20, the elapsed time period of the mode may be applied as the information concerning the stop time period. The elapsed time period until the print operation is first started after the operation of turning on the main power switch may also be applied as the information concerning the stop time period.

In the exemplary embodiments 2 and 3, the image forming apparatus may be configured as follows: When the main power switch is off, the humidity sensor 54 also operates and measures the humidity every required time until the next operation of tuning on the main power switch 56, and an average value of the humidities is used as information concerning the humidity. With this configuration, it is made possible to know the actual humidity environment when the developing device actually stops for a long time and to perform more appropriate control (actually, the special control described above). On the other hand, if the time when the humidity at the turning-on time of the main power switch is equal to or greater than the required setup value is detected as in the example of the information concerning the humidity in the above exemplary embodiment and the elapsed time period is replaced with the information concerning the humidity, it also becomes possible to switch appropriate control (actually, the special control described above) in accordance with the charge state of the developer in a time zone close to the next started developing operation.

In the exemplary embodiments 2 and 3, the controller 5 may also be configured so as to determine as to whether or not the special control is required, based only on the information concerning the stop time period of the developing device from the time detection counter 52 without receiving the information concerning the humidity from the humidity sensor 54.

Further, in the exemplary embodiments 2 and 3, the case where the two-component developing device is used as the developing device 24 is illustrated. However, a mono-component developing device using a mono-component developer made of a toner component (limited to a device for applying a developing bias obtained by superposing an AC component on a DC component to a developing roll) may also be used as the developing device 24.

In addition, in the exemplary embodiments 2 and 3, as the image forming device 20, the device for transferring the toner image formed on the photoconductive body 21 directly to the recording sheet 9 is illustrated. However the image forming device 20 may adopt an intermediate transfer system. The image forming apparatus 1 may be an apparatus for forming a multicolor image (color image) made up of toner images of multiple colors formed using plural developing device storing developers of different colors.

What is claimed is:

1. An image forming apparatus comprising:

an image forming device including a photoconductive body that rotates, an electrostatic latent image being formed on the photoconductive body, a developing device that develops the electrostatic latent image on the photoconductive body with a developer to form a developer image, the developer being supplied by a developer supply member which rotates and to which a developing voltage is applied; and a transfer device that transfers the developer image onto a recording medium;

a time detection unit that detects information concerning a stop time period of the developing device;

a humidity measurement unit that is provided in a casing in which the image forming device is provided and that measures a humidity; and a controller that controls the developer supply member in the developing device based on the information concerning the stop time period detected by the time detection unit and information concerning the humidity measured by the humidity measurement unit, so as to rotate at a lower speed than a rotation speed at a normal time before the developing device starts a first developing operation after the developing device stopped.

2. The image forming apparatus according to claim 1, wherein the controller sets a drive time period for which the developer supply member rotates at the lower speed, based on the information concerning the stop time period detected by the time detection unit and the information concerning the humidity measured by the humidity measurement unit, and the controller rotates the developer supply member at the lower speed only for the setup drive time period.

3. An image forming apparatus comprising:

an image forming device including a photoconductive body that rotates, an electrostatic latent image being formed on the photoconductive body, a developing device that develops the electrostatic latent image on the photoconductive body with a developer to form a developer image, the developer being supplied by a developer supply member which rotates and to which a developing voltage obtained by superposing an AC component on a DC component is applied, and a transfer device that transfers the developer image onto a recording medium;

a time detection unit that detects information concerning a stop time period of the developing device; and a controller that controls the image forming device based on the information concerning the stop time period detected by the time detection unit, so as to execute an image forming operation in a state where it is stopped to apply the AC component of the developing voltage to the developing device.

4. The image forming apparatus according to claim 3, wherein the controller starts to apply the AC component of the developing voltage based on information of a cumulative elapsed time or a cumulative number of image forming operation times after the image forming device started the image forming operation in a state where it is stopped to apply the AC component of the developing voltage.

5. The image forming apparatus according to claim 3, wherein the controller continuously or intermittently applies, as the AC component of the developing voltage, an AC voltage which has a smaller peak-to-peak voltage than a peak-to-peak voltage of an AC voltage at a normal time, based on information of an elapsed time after the image forming device started the image forming operation in a state where it is stopped to apply the AC component of the developing voltage.

6. The image forming apparatus according to claim 3, further comprising:

a humidity measurement unit that is provided in a casing in which the image forming device is provided and that measures a humidity, wherein the controller controls the image forming device based on both the information concerning the stop time period detected by the time detection unit and information concerning the humidity measured by the humidity measurement unit, so as to execute the image forming operation in the state where it is stopped to apply the AC component of the developing voltage to the developing device.

7. An image forming apparatus comprising:

an image forming device including a photoconductive body that rotates, an electrostatic latent image being formed on the photoconductive body, a developing device that develops the electrostatic latent image on the photoconductive body with a developer to form a developer image, the developer supplied by a developer supply member which rotates and to which a developing voltage obtained by superposing an AC component on a DC component is applied, and a transfer device that transfers the developer image to a recording medium;

a time detection unit that detects information concerning a stop time period of the developing device; and a controller that controls the image forming device based on the information concerning the stop time period detected by the time detection unit so as to execute an image forming operation in a state where a duty ratio of a voltage waveform of the AC component of the developing voltage applied to the developing device is changed to such a value that a ratio of a waveform portion which forms an electric field for attracting the developer from the developer supply member to the photoconductive body becomes smaller than that at a normal time.

8. The image forming apparatus according to claim 7, wherein the controller restores the duty ratio of the AC component of the developing voltage to a value at the normal time, based on information of a cumulative elapsed time or a cumulative number of image forming operation times after the image forming device started the image forming operation in the state where the duty ratio of the AC component of the developing voltage is changed.

9. The image forming apparatus according to claim 7, wherein the controller continuously or stepwise changes the duty ratio of the AC component of the developing voltage to such a value that the ratio of the waveform portion which forms the electric field for attracting the developer from the developer supply member to the photoconductive body becomes larger than the changed value, based on an elapsed time after the image forming device started the image forming operation in the state where the duty ratio of the AC component of the developing voltage is changed.

10. The image forming apparatus according to claim 7, further comprising:

a humidity measurement unit that is provided in a casing in which the image forming device is provided and that measures a humidity, wherein the controller controls the image forming device based on both the information concerning the stop time period detected by the time detection unit and information concerning the humidity measured by the humidity measurement unit, so as to execute image forming operation in the state where the duty ratio of the voltage waveform of the AC component of the developing voltage applied to the developing device is changed to such the value that the ratio of the waveform portion, which forms the electric field for attracting the developer from the developer supply member to the photoconductive body, becomes smaller than that at the normal time.

* * * * *